US011707767B2

(12) United States Patent
Abell et al.

(10) Patent No.: US 11,707,767 B2
(45) Date of Patent: Jul. 25, 2023

(54) HIGH FREQUENCY SCREEN WITH DUAL MOTOR TAPPET ASSEMBLIES

(71) Applicant: Astee Mobile Screens, Inc., Sterling, IL (US)

(72) Inventors: Chad D. Abell, Tampico, IL (US); Gary W. Eisenhower, Jr., Freeport, IL (US)

( * ) Notice: Subject to any disclaimer, the term of this patent is extended or adjusted under 35 U.S.C. 154(b) by 45 days.

(21) Appl. No.: 17/363,442

(22) Filed: Jun. 30, 2021

(65) Prior Publication Data

US 2022/0008957 A1 Jan. 13, 2022

Related U.S. Application Data

(60) Provisional application No. 63/049,272, filed on Jul. 8, 2020.

(51) Int. Cl.
*B07B 1/36* (2006.01)
*B07B 1/28* (2006.01)

(52) U.S. Cl.
CPC ..... *B07B 1/36* (2013.01); *B07B 1/284* (2013.01)

(58) Field of Classification Search
CPC .. B07B 1/28; B07B 1/284; B07B 1/34; B07B 1/343; B07B 1/36; B07B 1/42; B07B 1/54
See application file for complete search history.

(56) References Cited

U.S. PATENT DOCUMENTS

| | | | | |
|---|---|---|---|---|
| 5,232,099 A * | 8/1993 | Maynard | B07B 1/42 209/276 |
| 5,397,002 A * | 3/1995 | Lambert | B07B 1/34 209/382 |
| 5,456,364 A * | 10/1995 | Lambert | B07B 1/42 209/382 |
| 6,220,447 B1 * | 4/2001 | Lambert | B07B 1/54 209/381 |
| 2022/0274135 A1 * | 9/2022 | Grimm | B07B 1/36 |

* cited by examiner

*Primary Examiner* — Joseph C Rodriguez
(74) *Attorney, Agent, or Firm* — Chambliss, Bahner & Stophel, P.C.; Stephen D. Adams

(57) ABSTRACT

A vibratory screen assembly includes a rigid frame having a pair of parallel side members that are spaced apart such that a space is provided between them. A tappet assembly extending horizontally across the space between the side members includes a horizontal member having opposing ends secured to the frame. A screen placed over the tappet assembly provides a screening medium having a mesh size. A vibrator motor is located at each of the opposing ends of the horizontal member to form a cooperative pair of vibrator motors that induce vibrations in the horizontal member and in the screen. As the screen vibrates, aggregate material that is smaller than the mesh size passes through the screening medium and aggregate material that is larger than the mesh size does not pass through the screening medium.

20 Claims, 10 Drawing Sheets

HIGH FREQUENCY SCREEN WITH DUAL MOTOR TAPPET ASSEMBLIES

CROSS-REFERENCE TO RELATED APPLICATIONS

This application claims the benefit of U.S. Provisional Application No. 63/049,272 filed Jul. 8, 2020, and entitled HIGH FREQUENCY SCREEN WITH DUAL MOTOR TAPPET ASSEMBLIES, which is incorporated herein by reference in its entirety.

FIELD

The present invention relates generally to vibratory screen apparatus employed in the classifying of solid particulate matter. More particularly, the present invention relates to a high frequency vibratory screen apparatus having tappets driven by dual end-mounted motors.

BACKGROUND

Vibrating screen assemblies have been widely used in the past for the classification and separation of particulate solids of varying sizes and compositions. With initial reference to FIGS. 1-3, there is provided a vibratory screen assembly 100, which may be used to classify and separate aggregate and other particulate material M into two or more differently-sized products. A typical vibratory screen assembly 100 is comprised of a rigid frame 102 having an upper end 102A and a lower end 102B that is positioned vertically lower than the upper end. The frame 102 includes a pair of elongate side members 104 that are spaced apart and held in generally parallel relationship to each other and one or more vertically-displaced rows of horizontal members 106 that extend between the side members. The horizontal members 106 are not rigidly mounted between the side members 104. Instead, the horizontal members 106 are configured to rock or pivot slightly about their ends.

Vibratory screen assemblies 100 usually have some type of vibrating mechanism to shake the unit. The vibrating mechanisms usually include an unbalanced weight mounted on one or several rotating shafts which, when rotated, force a cycling motion into the screen machine. The resulting motion can have a circular path, linear path, elliptical path, or any combination of those shapes. This cycling motion is referred to as the screen stroke and can range in total displacement in any direction from less than ¾" to more than 1". In this case, a vibrator motor 108 is mounted to the bottom and at the center of each horizontal member 106 (this combination is sometimes call a "tappet assembly").

An alternative vibratory screen assembly 100' is shown in FIG. 4, where the vibrator motor 108 is mounted within a tube 112 (one of which is shown in FIG. 4) having closed ends 114, which tube replaces the horizontal members 106 discussed previously. In each case, the vibration caused by the vibrator motor 108 causes a screen 110 to also vibrate. As shown in FIG. 1, screens 110 are often provided with a screen medium, such as a wire mesh, which is placed across the horizontal members 106. In some cases, the entire vibratory screen assembly 100, including the frame 102 and the screen 110, are vibrated. In other cases, the frame 102 is isolated from the vibrating screens 110.

Solids that are to be classified pass over the vibrating screens 110 and travel in a flow direction F from the upper end 102A to the lower end 102B of the frame 102. As the solids move along the screens 110, they are separated and classified by either passing through openings in the screen medium (i.e., unders) or by passing over the screen medium (i.e., overs). Pivot mounting tubes 116 allow the frame 102 to be suspended from a support structure and for the frame to pivot upwards such that upper end 102A is held vertically higher than the lower end 102B. The vibrating screen assembly 100 also includes a chute 118 (chutes 118A and 118B are illustrated) that are located adjacent the lower end 102A of the frame 102 adjacent the end of each row of horizontal members 106. Upper chute 118A is intended to collect the "overs" and lower chute 118B is intended to collect the "unders". Each chute 118 then directs the collected material to appropriate size-segregated locations (e.g., separate piles of material based on size).

Capacity and efficiency are two important considerations in assessing the design and utility of vibratory screening apparatuses. The capacity of a screening apparatus is a factor of the width of the frame 102 and screen 110, and a wider frame and screen allows for more material to be screened per unit time than a narrower frame and screen. Conventional screening apparatuses, such as apparatus 100, typically utilize screens 110 that are approximately 6 feet in width. Thus, a wider screen 110 that could allow for a higher capacity is preferable. Next, efficiency is determined by how well and how quickly the aggregate material is distributed across the width of the screen 110 and processed. To maximize screening efficiency, the material that is being sorted is quickly and evenly dispersed across the entire surface of the screen 110 in order to expose more of that material to the screen media and to maximize the amount of the screen media that is actively screening at one time. Additionally, the efficiency of a screening apparatus is correlated to its downtime or the amount of time and cost required to maintain the machine.

As mentioned above and as shown best in FIGS. 3 and 4, conventional vibratory screen assemblies 100 often utilize a single vibrator motor 108 that is positioned in the center of each the horizontal members 106 or within a tube 112. As the width of the screen 110 is increased, the length and weight of the horizontal members 106 and tubes 112 increase and performance using a single motor are adversely impacted. Additionally, when the vibrator motor 108 is mounted below the middle of the screen 110, the weight of the motor dampens vibrations of the screen directly above and in the immediately surrounding area of the screen. Thus, the greatest vibrations from the vibrator motor 108 are spaced away from the center (e.g., at the edges of the screen). This vibration tends to funnel aggregate material away from the sides of the screen and towards the relatively calmer (i.e., dampened) center portion of the screen. Thus, use of the entire width of the screen is adversely impacted by placing the single motor at the middle of the screen. This problem is exacerbated when the aggregate material is initially deposited at the center of the screen 110, which makes spreading the material to the edges of the screen to facilitate efficient screening much more difficult.

Next, the installation and maintenance of the vibrator motor 108 is difficult because special equipment is frequently needed to reach the center of the frame 102 in order to mount the motor to the horizontal members 106 or within the tube 112. Additionally, the hoses, air lines, etc. (generally and collectively referred to herein as connections 120) that are connected to the vibrator motor 108 extend from the center of the frame 102 and then through the side members 104. Routing the connections 120 in this manner through the frame 102 exposes the connections to heat, aggregate, etc., within the screening apparatus 100, which can create frequent maintenance and reliability issues (i.e., downtime). Additionally, a leaking connection 120, such as a hydraulic line, can spill hydraulic fluid and contaminate the aggregate material being processed. Next, enclosing the connections 120 within a tube 112 may not fully protect them from falling debris, etc., or protect the aggregate from contamination since these tubes 112 are often provided with access or maintenance openings, which could permit transmission of aggregate, fluids, and other contaminants. Also, fully enclosing the vibrator motor 108 may actually cause it to overheat in the enclosed environment due to the lack of airflow. This can, therefore, limit the type and amount of aggregate material (e.g., certain types of fine sand) that can be processed.

What is needed, therefore, is a screening apparatus having tappet assemblies that will allow for greater screening capacity and efficiency than conventional screening apparatuses having a single, center-mounted vibrator motor.

Notes on Construction

The use of the terms "a", "an", "the" and similar terms in the context of describing embodiments of the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "attached", "connected" and "interconnected", refer to a relationship wherein structures are secured or attached to one another either directly or indirectly through intervening structures, as well as both moveable and rigid attachments or relationships, unless otherwise specified herein or clearly indicated as having a different relationship by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity.

SUMMARY

The above and other problems are addressed by a vibratory screen assembly for classifying and separating aggregate materials into two or more size-segregated portions. The screen assembly includes a rigid frame having a pair of elongate side members that are spaced apart and held in a generally parallel relationship to each other such that a space is provided between the elongate side members. A tappet assembly extends horizontally across the space and between the elongate side members of the rigid frame. The tappet assembly includes a horizontal member having opposing ends secured to the frame. A separate vibrator motor is located at each of the opposing ends of the horizontal member to form a cooperative pair of vibrator motors that vibrate in conjunction with one another to induce vibrations in the horizontal member. A screen placed over the tappet assembly provides a screening medium having a mesh size that is configured to separate aggregate materials placed onto the screen into two separate size-segregated portions. The screen vibrates as the horizontal member vibrates and, as the screen vibrates, aggregate material that is smaller than the mesh size passes through the screening medium and aggregate material that is larger than the mesh size does not pass through the screening medium.

In certain embodiments, a first tappet assembly row extends between an upper end proximate one longitudinal end of the rigid frame and a lower end proximate an opposite longitudinal end of the rigid frame. The first tappet assembly row formed by two or more tappet assemblies that each extend horizontally across the space and between the elongate side members of the rigid frame and that are vertically displaced from one another. As such, a first tappet assembly of the first tappet assembly row is at a highest vertical position with respect to the first tappet assembly row. Additionally, a second tappet assembly of the first tappet assembly row is located at a lowest vertical position with respect to the first tappet assembly row. The screen is placed over the first tappet assembly row. In certain embodiments, a plurality of a tappet assemblies each extend horizontally across the space between the elongate side members of the rigid frame. One or more screens are placed over the plurality of tappet assemblies to substantially fill the space within the frame.

In certain cases, the first tappet assembly row further includes one or more first intermediate tappet assemblies that each extend horizontally across the space between the first tappet assembly and the second tappet assembly of the first tappet assembly row. Preferably, the first intermediate tappet assemblies are vertically displaced from one another between the highest and lowest vertical position with respect to the first tappet assembly row.

In certain embodiments, a second tappet assembly row extends between the upper end and the lower end of the rigid frame and is vertically displaced with respect to the first tappet assembly row. The second tappet assembly row is formed by two or more tappet assemblies that each extend horizontally across the space and between the elongate side members of the rigid frame and that are vertically displaced from one another. As such, a first tappet assembly of the second tappet assembly row is located at a highest vertical position with respect to the second tappet assembly row. Additionally, a second tappet assembly of the second tappet assembly row is at a lowest vertical position with respect to the second tappet assembly row. A first screen having a first mesh size is placed over the first tappet assembly row and a second screen having a second mesh size is placed over the second tappet assembly row.

In certain embodiments, openings are formed in each end of the horizontal member of the tappet assembly and pairs of aligned openings are formed in the frame. When the tappet assembly extends between the elongate side members of the rigid frame, one of the openings of the horizontal member is aligned with one of the aligned openings in the frame such that one of the vibrator motors may be inserted through each one of the aligned openings in the frame and then into the opening in the end of the horizontal member. In some cases, the horizontal member of the tappet assembly is a cylindrical tube having opposing open and hollow ends. The vibratory screen assembly includes connections that are connected to each of the vibrator motors and that are used in powering or controlling the vibrator motor. In some cases, a portion of the connections extends through the aligned openings in the frame in order to connect to the vibrator motor. In other cases, the connections are located exclusively outside of the frame when connected to the vibrator motor. In some cases, the opening in the end of the horizontal member is sized such that a first end of the vibrator motor is located on an inner side of the side members of the rigid frame and a second end of the vibrator motor is located on an outer side of the side members of the rigid frame when the vibrator motor is connected to the horizontal member and the opposing ends of the horizontal member are secured to the side members of the rigid frame.

In certain embodiments, a bolting surface is located proximate each opening in the ends of the horizontal member. The bolting surface is configured to mount to an end of one of the vibrator motors for securely connecting the vibrator motor to the horizontal member. In certain cases, the bolting surface is a ring-shaped block fixedly attached inside of the horizontal member that includes threaded bolt openings, each configured to receive a bolt, and surrounding a center opening. The vibrator motor includes corresponding openings to enable a bolt to pass through the openings in the vibrator motor and then threaded into the threaded bolt openings in the bolting surface.

In certain cases, the vibratory screen assembly includes a flange surrounding an outer surface of each end of the horizontal member and a vibration isolating seal surrounding each end of the horizontal member. In use, the vibration isolating seal is placed into contact with and is preferably slightly compressed between an inner surface of the elongate side member and the flange. The flange may include an upper flange that is located on and that partially surrounds a top of the horizontal member. Additionally, the flange may further include a separate lower flange that is located on and that partially surrounds a bottom of the horizontal member. Additionally, the vibration isolating seal may include a notched sealing ring having a pair of spaced apart arc-shaped notches that are formed in an outer periphery of the notched sealing ring. The vibration isolating seal may also include a pair of cylindrical vibration isolators that are each sized to seat within one of the notches of the notched sealing ring. Preferably, when the horizontal member is mounted between the elongate side members, each of the notched sealing rings is compressed between one of said upper flanges and a corresponding one of said elongate side members. Further, when the horizontal member is mounted between the elongate side members, each pair of cylindrical vibrations isolators is compressed between one of said lower flanges and a corresponding one of said elongate side members. In certain cases, a distance D1 separates the inner surface of the elongate side member and the corresponding upper flange. Additionally, a distance D2, which is greater than distance D1, separates the inner surface of the elongate side member and the corresponding lower flange.

The present disclosure also provides a tappet assembly configured for use in a vibratory screen assembly for classifying and separating aggregate materials into two or more size-segregated portions, where the screen assembly includes a rigid frame having a pair of elongate side members that are spaced apart and held in a generally parallel relationship to each other such that a space is provided between the elongate side members. The tappet assembly includes a horizontal member having opposing ends and is sized to extend across the space of the rigid frame when the opposing ends are secured to the side members. A vibrator motor is connected at each of the opposing ends of the horizontal member. These vibrator motors form a cooperative pair that are configured to vibrate in conjunction with one another to vibrate the horizontal member and, indirectly, the screen and aggregate material placed onto the screen. In some embodiments, the vibrator motors extend outwards from each of the open and hollow ends of the horizontal member such that a second end of the vibrator motors is spaced away from the open and hollow ends. In certain cases, the tappet assembly includes a screen support that extends away from a top of the tube and that is configured to support a screen above the cylindrical tube. Additionally, a screen interface is removably attached to screen support and is configured to be contacted by the screen and to hold the screen in position above the cylindrical tube when the cylindrical tube is vibrated.

The present disclosure also provides a method for separating aggregate material into two or more size-segregated portions. The method includes the step of providing vibratory screen assembly having: a rigid frame having a pair of elongate side members that are spaced apart and are held in a generally parallel relationship to each other such that a space is provided between the elongate side members; a tappet assembly row extending along at least a portion of a length of the rigid frame and comprised of a plurality of vertically separated tappet assemblies, each tappet assembly including: a horizontal member having opposing ends secured to the frame and a cooperative pair of vibrator motors mounted to each horizontal member that vibrate in conjunction with one another, each cooperative pair of vibrator motors including one vibrator motor disposed at each opposing end of the horizontal member; and a screen providing a screening medium having a mesh size placed over the tappet assembly row. The method also provides the steps of placing unscreened aggregate material onto the screen and creating vibrations in the screen using one or more of the vibrator motor pairs to move the aggregate material across the screen. Finally, as a result of the vibrations in the screen and the movement of the aggregate material across the screen, the aggregate material is separated into two or more size-segregated portions, including a larger portion located on top of the screen and a smaller portion located underneath the screen. In certain embodiments, the method also provides the step of operating the vibrator motors in a first operational mode to provide a first shape of aggregate material moving across the screen and then operating the vibrator motors in a second operational mode to provide a second shape of aggregate material moving across the screen.

BRIEF DESCRIPTION OF THE DRAWINGS

Further advantages of the invention are apparent by reference to the detailed description when considered in conjunction with the figures, which are not to scale so as to more clearly show the details, wherein like reference numerals represent like elements throughout the several views, and wherein.

DETAILED DESCRIPTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Figure 5A:
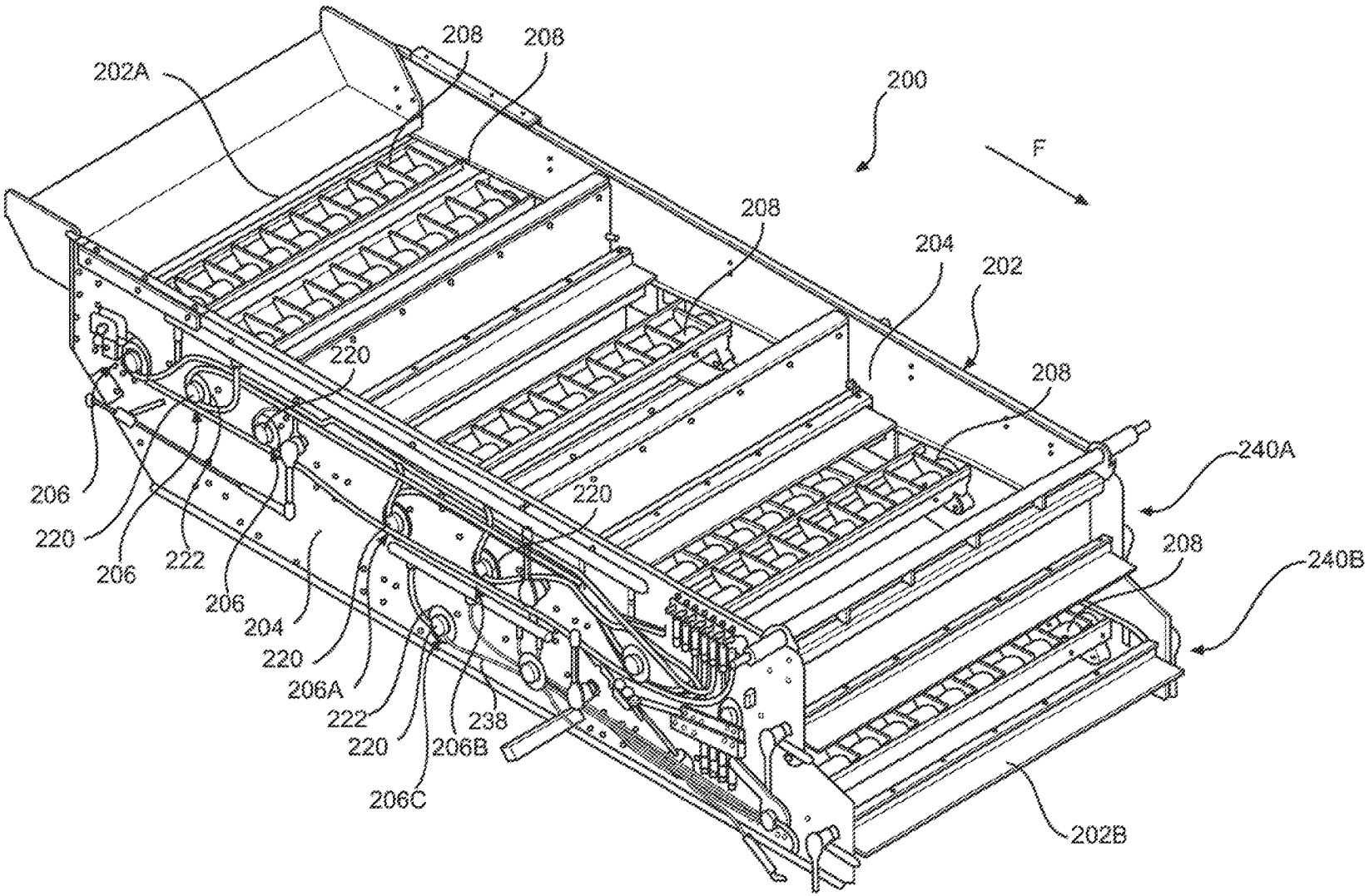
FIG. 5A is a perspective view that depicts a vibratory screen assembly according to an embodiment of the present invention.
Figure 5B:
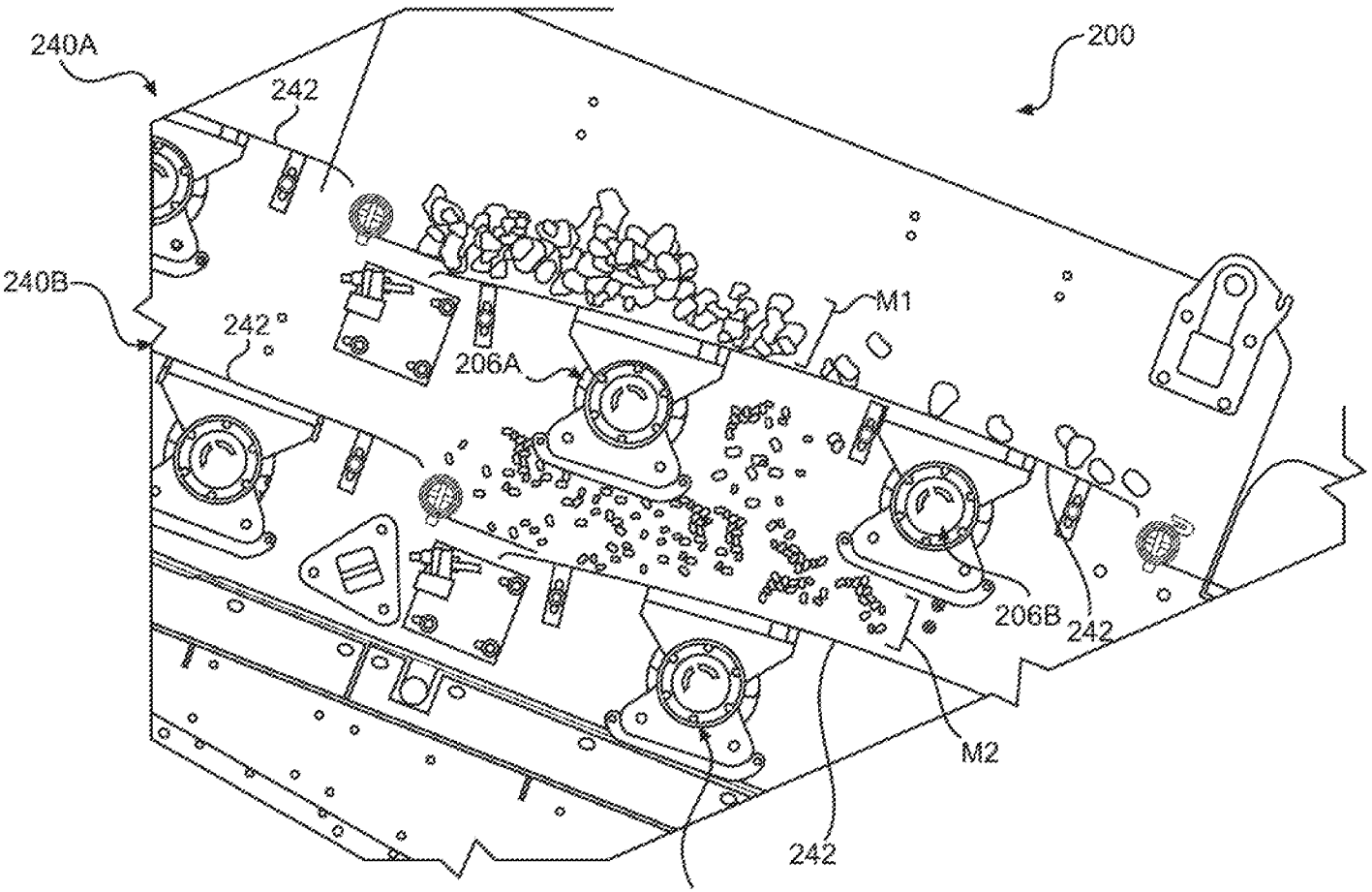
FIG. 5B is a section view of a portion of the vibratory screen assembly of FIG. 5A taken along a plane extending through the screen assembly parallel with flow direction F and showing intermediate tappet assemblies segregating aggregate material into two or more size-segregated portions.
Figure 6:
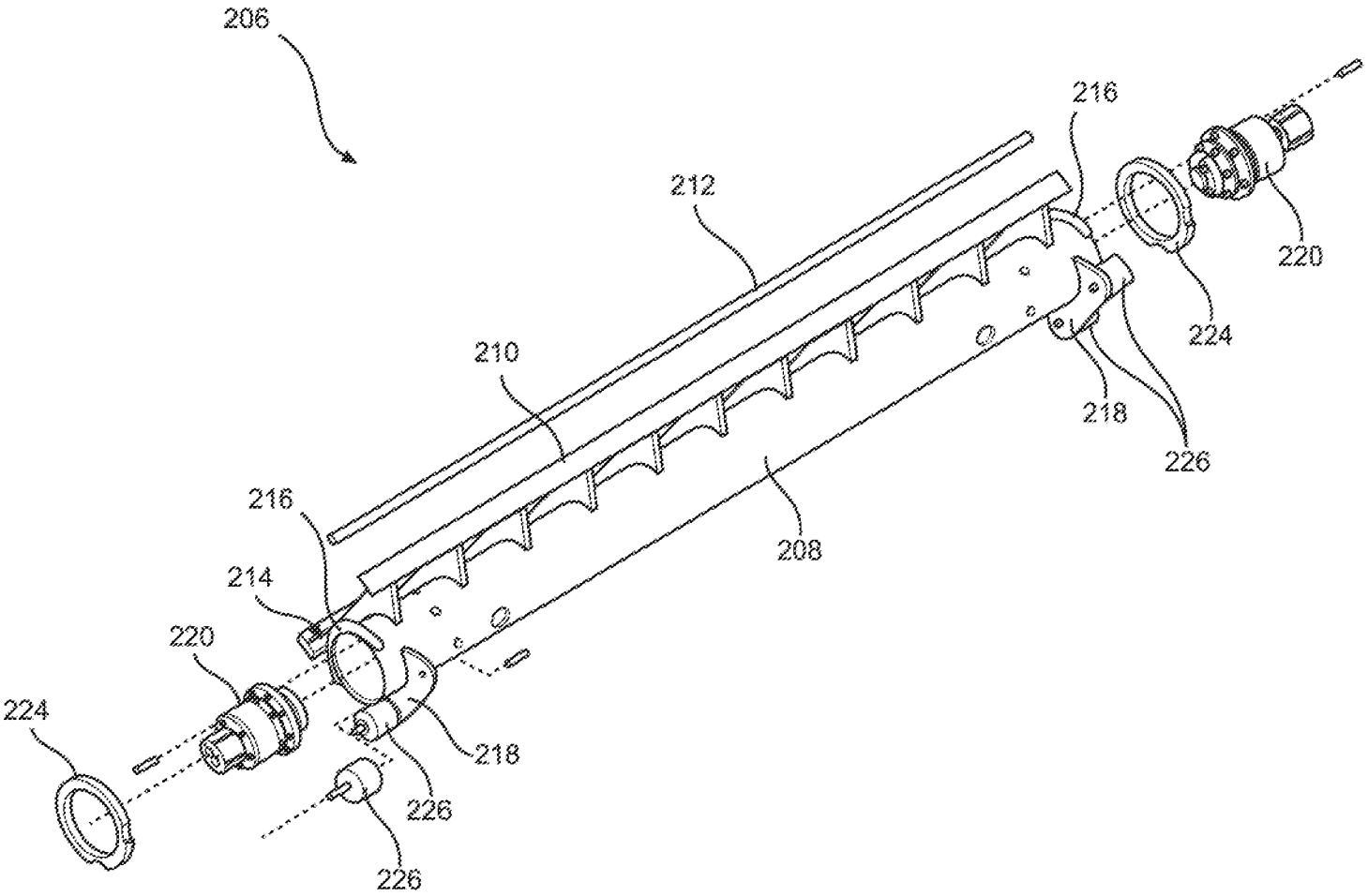
FIG. 6 is a perspective view that depicts a tappet assembly having dual, end-mounted vibrator motors mounted within a horizontal tube configured for use in a vibratory screen assembly according to an embodiment of the present invention.

Referring now to FIGS. 5A and 5B, there is provided a vibratory screen assembly 200 according to an embodiment of the present invention, which assembly may be used to classify and separate aggregate and other particulate into two or more differently-sized (i.e., size segregated) products or portions.

Vibratory screen assembly 200 is comprised of a rigid frame 202 having an upper end 202A located proximate one longitudinal end of the frame and a lower end 202B located proximate an opposite longitudinal end of the frame. The frame 202 includes a pair of elongate side members 204 that are spaced laterally apart and held in generally parallel relationship to each other. One or more vertically-displaced tappet assembly rows 240 that each include a plurality of horizontal tappet assemblies 206 each preferably extend at least partially between the upper end 202A and the lower end 202B and also between the side members 204 of the rigid frame 202. The illustrated embodiment shows a first and upper tappet assembly row 240A that is formed by three tappet assemblies 206, including assemblies 206A and 206B, and a second and vertically lower tappet assembly row 240B that is also formed by three other tappet assemblies, including assembly 206C. Other embodiments of the screen assembly 200 may provide fewer or greater numbers of tappet assembly rows 240 that each have fewer or greater numbers of tappet assemblies 206.

In certain embodiments, the tappet assemblies 206 that form each tappet assembly row 240 are also vertically displaced from one another such that a first tappet assembly located at the upper end 202A of the frame 202 is located at the highest vertical position with respect to the tappet assembly row and a second tappet assembly located at the lower end 202B of the frame is located at the lowest vertical position with respect to the tappet assembly row. In certain preferred embodiments, one or more intermediate tappet assemblies 206 also extend horizontally across the space and are located between the first tappet assembly and the second tappet assembly of each tappet assembly row. The intermediate tappet assemblies 206 are also preferably vertically displaced from one another and are vertically positioned between the highest and lowest vertical position with respect to the tappet assembly row. In FIGS. 5A and 5B, intermediate tappet assemblies 206A, 206B, and 206C are shown and are located at a central position between longitudinal ends of vibratory screen assembly 200. Tappet assemblies 206A and 206B are used in forming an upper tappet assembly row 240A and tappet assembly 206C is used in forming a lower tappet assembly row 240B that is located vertically below the upper tappet assembly row. As shown, additional tappet assemblies located on either longitudinal end of these intermediate tappet assemblies 206A-206C may also be provided to extend the length of the tappet assembly rows 240.

The above-described vertical offsets of the tappet assembly rows 240 and also of the tappet assemblies 206 within each row provide a sloped surface or a series of stair stepped surfaces onto which one or more screens 242 (shown in FIG. 5B) are placed for the purpose of screening aggregate material. In certain embodiments, these screens 242 extend, either continuously or discontinuously, along a portion of or substantially the entire length of the screen assembly 200 from the upper end 202A to the lower end 202B and between the elongate side members 204 in order to partially fill or to substantially fill the space within the rigid frame 202 such that aggregate placed onto the screen must pass through the screen in order to fall to a lower level of the screen assembly 200.

The tappet assemblies 206 are not rigidly mounted between the side members 204. Instead, the tappet assemblies 206 are configured to vibrate, rock or pivot slightly about their ends, which produces movement (i.e., vibrations) within the screens 242. Solids (e.g. aggregate materials) that are to be classified are placed onto the screens 242. Each of the screens 242 is provided with a screen medium that separates the aggregate and other material based on size. As the tappet assemblies 206 are moved (i.e., vibrated, rocked or pivoted), the screens 242 vibrate and aggregate material may be filtered through screening media of one or more screens. The screening media have progressively finer screen openings to provide two (or more, depending on the number tappet assembly rows 240) separate streams of material, based on size. More specifically, aggregate that is smaller than the screen openings of the screening medium falls through the screen, whereas aggregate that is larger than the screen openings remains on top of the screen. For example, in the illustrated embodiment, tappet assembly row 240A is provided with screens 242 having a first mesh size and tappet assembly row 240B is provide with other screens having a second (and smaller) mesh size. A first aggregate material portion M1 that is larger than the first mesh size remains on top of the screens 242 of tappet assembly row 240A but a second aggregate material portion M2 that is smaller than the first mesh size fall through the screens onto the screens of tappet assembly row 240B. Preferably, the process is repeated until all of the aggregate material has traveled (i.e., filtered down) to the appropriate tappet assembly row 240 and then along the screens 242 to the lower end 202B of the frame 202, such that the aggregate is divided into two or more separate size-segregated portions.

With continued reference to FIGS. 5A and 5B and with further reference to FIGS. 6-10, in preferred embodiments, each tappet assembly 206 includes a horizontal member 208 having one or more screen supports 210 that are configured to hold the screens 242, used in screening aggregate material as described above, away from the top of the horizontal member. In preferred embodiments, a removable screen interface 212 is placed onto the screen supports 210 and is positioned between the screen support and the screens 242 to prevent damage to the tappet assembly 206 and screen and to assist in holding the screen securely in place on the screen support through friction during operation of the screen assembly 200. In the illustrated embodiment, screen interfaces 212 are formed as rubber sleeves that fit onto the screen supports 210. However, in other cases, the screen interfaces 212 may be formed from other similar materials, including surface coatings, which provide suitable friction to hold the screen 242 to the screen support 210 and above the horizontal member 208.

Next, unlike conventional vibratory screen assemblies, which have only a single vibrator motor per each horizontal member, the present vibratory screen assembly 200 includes separate vibrator motors 220 located at opposing ends of each of the horizontal members 208 such that each horizontal member is provided with a pair of cooperative vibrator motors. In preferred embodiments, the horizontal members 208 are formed as partially or entirely hollow cylindrical tubes and each end of the cylindrical tubes is provided with an open end 214 that is sized to receive one of the vibrator motors 220. When the horizontal members 208 are mounted within the frame 202 between the elongate side members 204, opposing open ends 214 are each located adjacent one of a pair of aligned openings 222 formed in the elongate side members of the rigid frame that each align with one of the open ends of the horizontal members. Once the horizontal member 208 is mounted within the frame 202, open ends 214 are sized and configured to receive a vibrator motor 220, which may be inserted first through the openings 222 in the elongate side members 204 and then into the open ends of the horizontal members. Locating these vibrator motors 220 in the open ends 214 of the horizontal members 208 provides for easy installation, access, repair, etc. of the vibrator motors within the horizontal members. In preferred embodiments, vibrator motors 220 may be installed into the horizontal members 208 from outside the frame 202.

Figure 8:
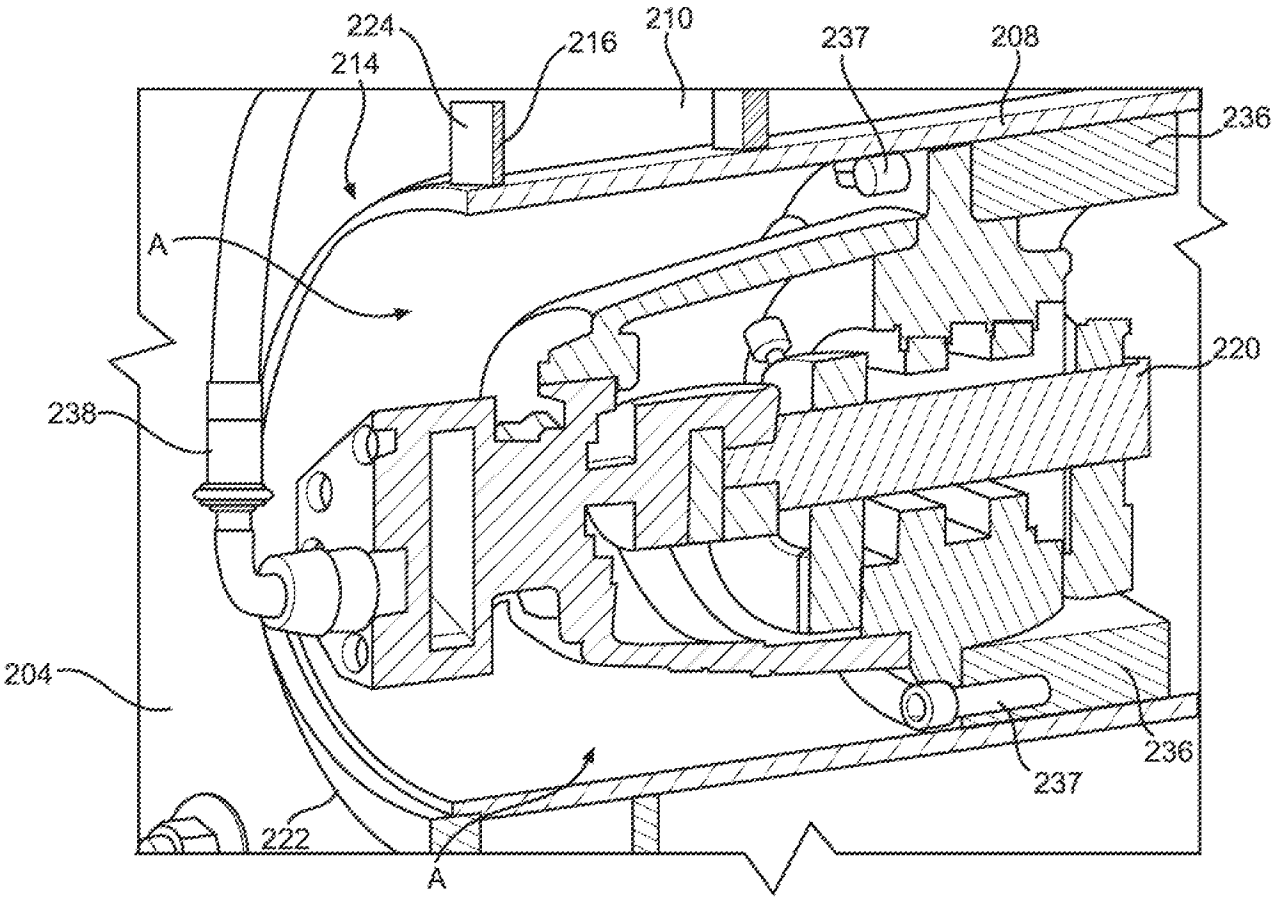
FIG. 8 is a detail view depicting the portion of FIG. 7 identified by "FIG. 8"
Figure 9:
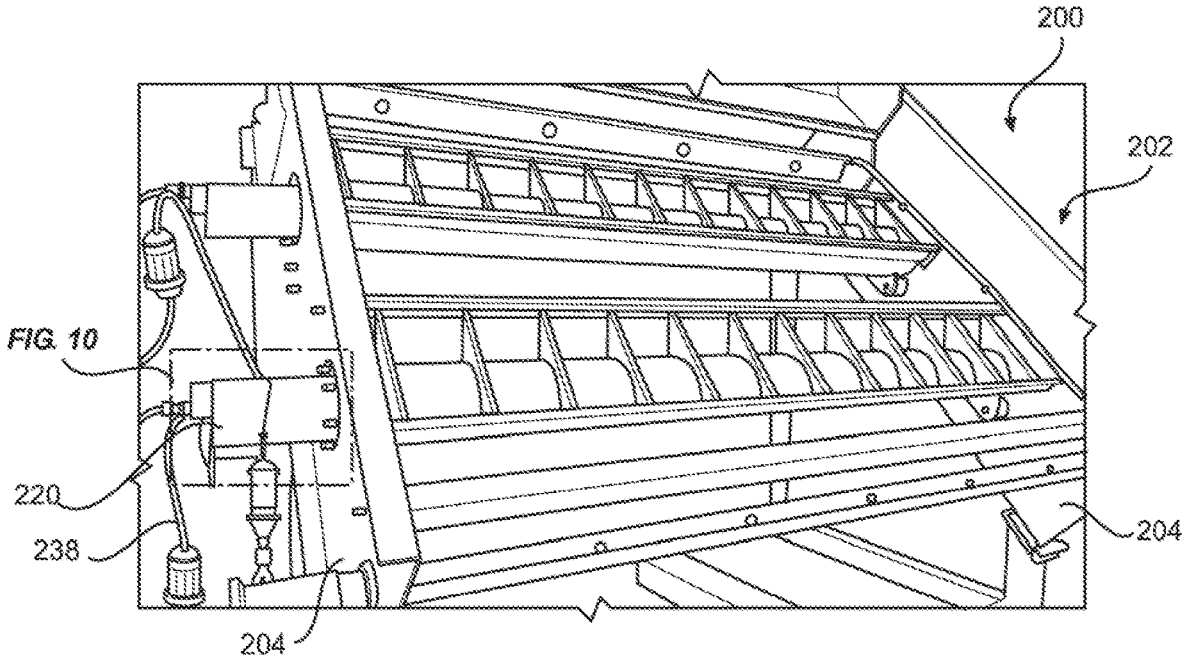
FIG. 9 is a perspective view depicting a tappet assembly mounted to a vibratory screen assembly according to an embodiment of the present invention.
Figure 10:
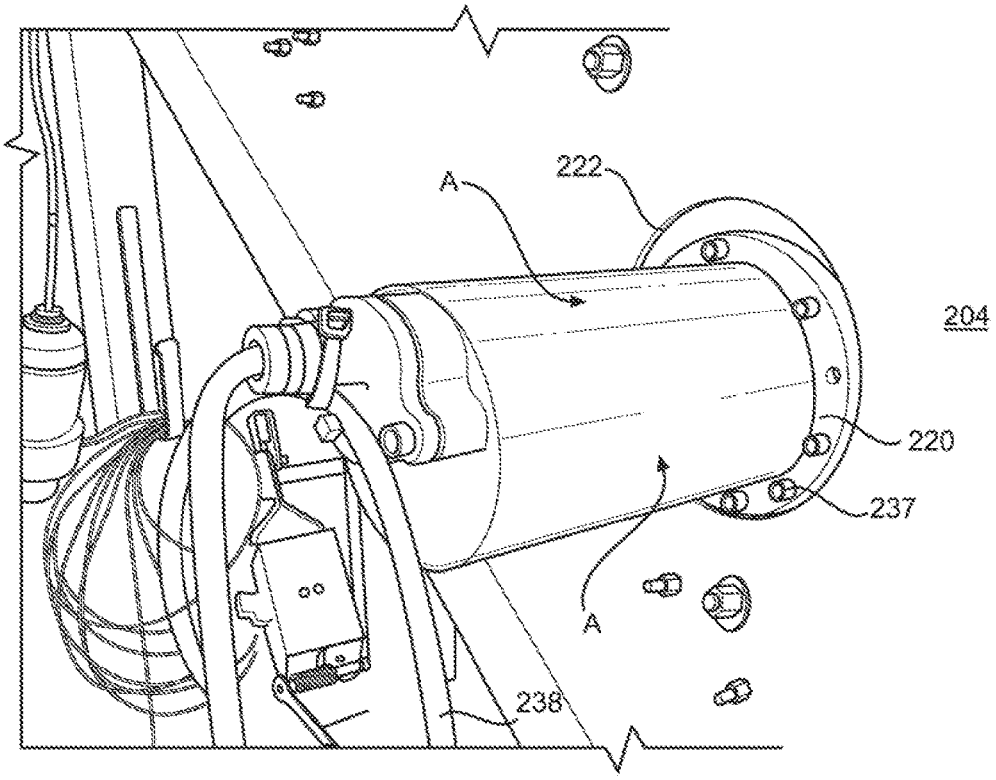
FIG. 10 is a detail view depicting the portion of FIG. 9 identified by "FIG. 10"

Preferably, vibrator motors 220 are powered by electric, hydraulic, pneumatic or other similar means. Further, due to the vibrator motors' 220 location at the open ends 214 of the horizontal members 208 and at the openings 222 in the side members 204 of the frame 202, the connections 238 (e.g., hoses, air lines, etc.) that are connected to the vibrator motor are preferably located substantially outside of the frame 202 (as shown in FIG. 8). More preferably, the connections 238 are connected to the vibrator motor 220 are located exclusively outside of the frame 202 (as shown in FIG. 10). Mounting vibrator motors 220 at the elongate side members 204 of the frame 202 and placing the connections 238 substantially or exclusively outside of the frame reduces or eliminates entirely the danger of the aggregate located within the rigid frame 202 from being contaminated by a fluid from a leaking connection. Additionally, the installation, removal, and maintenance of vibrator motor 220 is much simpler and quicker from outside the frame 202.

Figure 1:
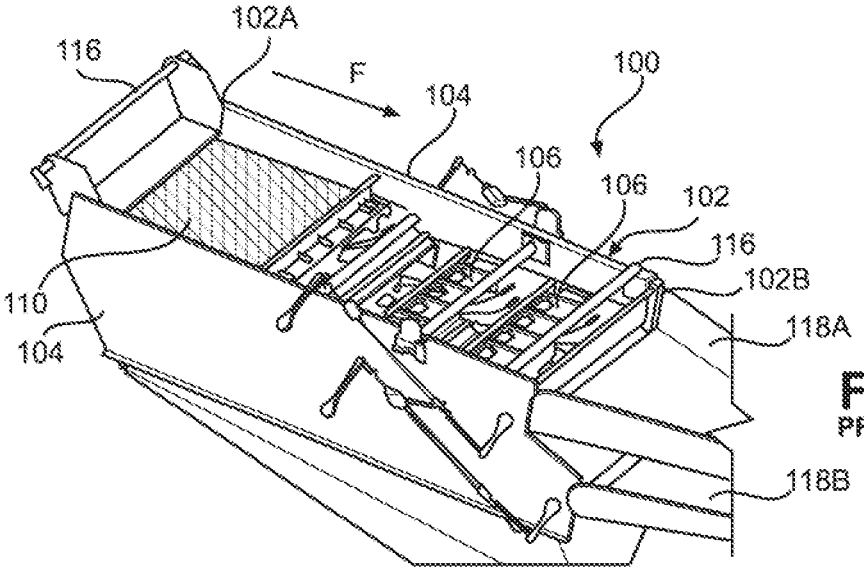
FIG. 1 PRIOR ART
FIG. 1 is a perspective view of a conventional vibratory screen assembly.
Figure 2:
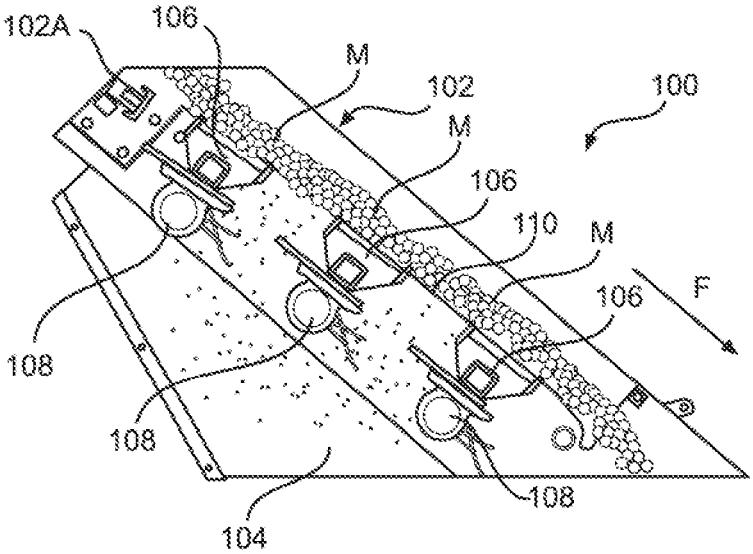
FIG. 2 PRIOR ART
FIG. 2 is a sectional view of a portion of the vibratory screen assembly of FIG. 1 taken along a plane extending through the screen assembly parallel with a flow direction F.
Figure 3:
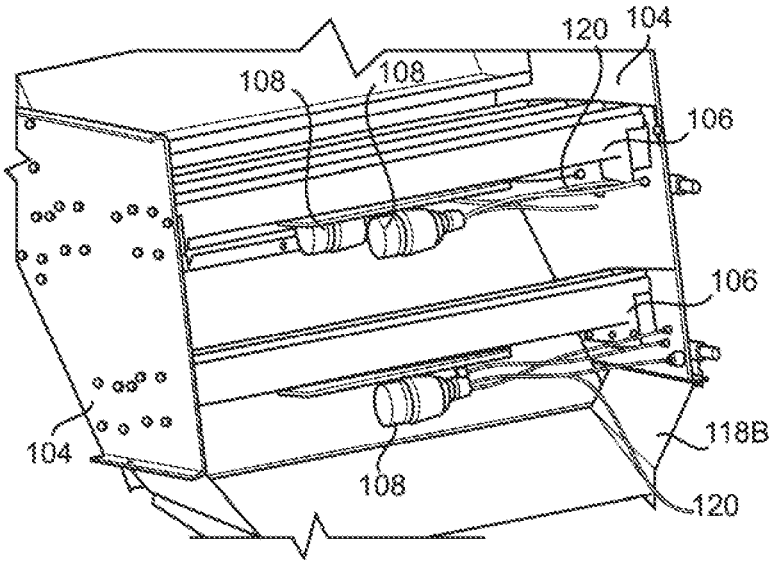
FIG. 3 PRIOR ART
FIG. 3 is a sectional view of the vibratory screen assembly of FIG. 1 taken along a plane extending through the screen assembly perpendicular to flow direction F and depicting a conventional single, center-mounted vibrator motor mounted below each horizontal member.
Figure 4:
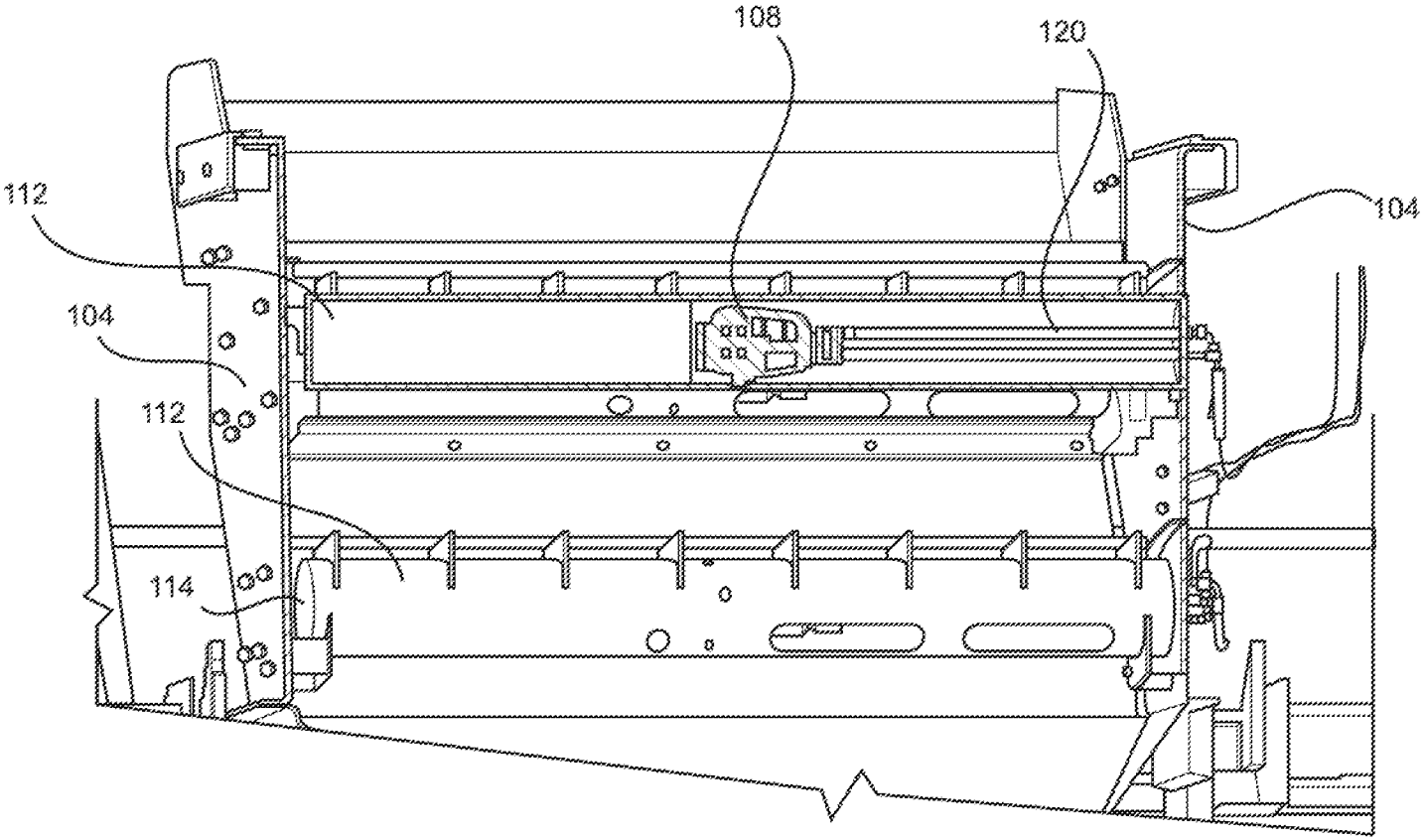
FIG. 4 PRIOR ART
FIG. 4 is a sectional view similar to the view of FIG. 3 but illustrating an alternative conventional single, center-mount vibrator motor mounted within a horizontal tube.

As shown in FIG. 8, in preferred embodiments, a bolting surface 236 having tapped openings is fixedly mounted within the horizontal members 208 and provides a mounting location for receiving bolts 237 for fixedly mounting the vibrator motor 220 within the horizontal member. In illustrated the embodiment, the bolting surface 236 is provided in a tapped ring-shaped block. Preferably, the vibrator motor 220 is provided with corresponding openings and the tapped openings in the bolting surface 236 are positioned such that bolts 237 may be inserted from outside of the frame 202 and through open ends 214. In certain embodiments, the vibrator motor 220 is located entirely within the horizontal member 208, with one end being mounted to the bolting surface 236 and the other end located adjacent (but still within) the open end 114. In other cases, such as the embodiment shown in FIGS. 9 and 10, one end of the vibrator motor 220 is attached to the bolting surface 236 within the horizontal member 208 and the opposite end extending out of the horizontal member 208 through the open end 114 and, optionally, also through the openings 222 formed in the side members 204. In this way, the other end of the vibrator motor 220 (i.e., the end not mounted to bolting surface 236) is spaced away from an outer surface of the rigid frame 202. Locating the vibrator motors 220 at the ends of the horizontal members 208 exposes the vibrator motor 220 to significantly more airflow A compared to the airflow over the conventional vibrator motor 108 (shown in FIG. 4) that is located in the center of tube 112. For that reason, vibrator motor 220 is much less likely to overheat, able to operate for longer time periods and able to operate under heavier loads compared to the vibrator motors, such as motor 108, of conventional vibratory screen assemblies.

With reference to FIGS. 11-14, in certain embodiments of the invention, each open end 214 of the horizontal member 208 is provided with an upper flange 216 that is located on and partially surrounds the top of the horizontal member and a separate lower flange 218 that is located on and partially surrounds the bottom of the horizontal member. As detailed below, the upper flange 216 and lower flange 218 function as bearing surfaces and as gauges used in mounting the open ends 214 of the horizontal member 208 to the frame 202 with correct spacing and also for limiting vibrations that are transmitted from the tappet assembly 206 to the frame. In certain embodiments, the upper flange 216 and lower flange 218 are formed as a single continuous flange.

Figure 14:
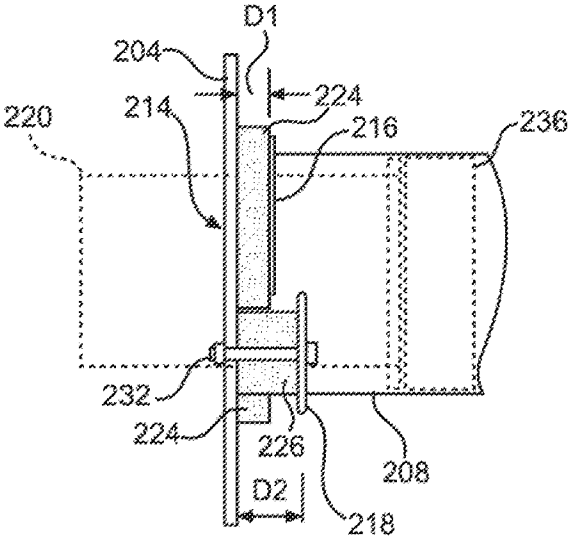
FIGS. 13 and 14 are elevation views illustrating one end of a tappet assembly being mounted to a frame of a vibratory screen assembly according to an embodiment of the present invention.
Figure 13:
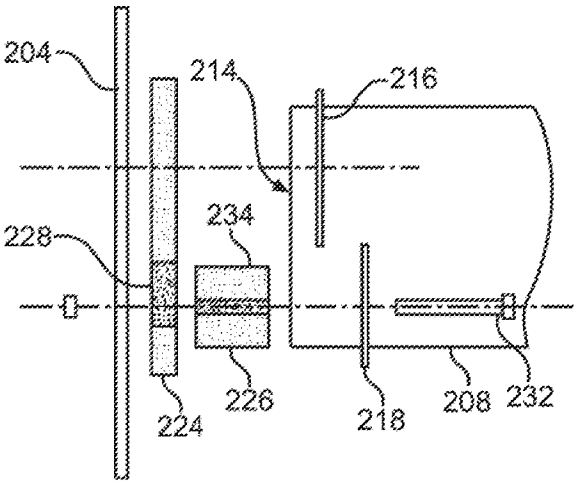

Each open end 214 of the tappet assembly 206 includes a vibration isolating seal that isolates the vibration of the horizontal member 208 from the frame 202 and that assists in preventing aggregate material from entering the horizontal member. The vibration isolating seal is comprised of a notched sealing ring 224 and a pair of cylindrical vibration isolators 226. Preferably the notched sealing ring 224 and the vibration isolators 226 are formed from a compressible material, such as 70 durometer compressible rubber or the like. At each open end 214 of the horizontal member 208, the sealing ring 224 is placed around and preferably entirely encircles the end of the horizontal member. The sealing ring 224 is configured to slide along the length of the horizontal member 208 until it contacts the upper flange 216, which serves as a gauge and provides positive feedback when the sealing ring is located at the correct location along the length of the horizontal member. Preferably, the upper flange 216 prevents the sealing ring 224 from sliding beyond the upper flange along the horizontal member 208. Preferably, the left-to-right distance (as shown in FIGS. 13 and 14) between the upper flange 216 and the side member 204 when the horizontal member 208 is attached to the frame 202 is less than the left-to-right width of the sealing ring 224. As such, the sealing ring 224 is slightly compressed between the upper flange 216 and the side member 204 when the horizontal member 208 is mounted to the frame 202. The sealing ring 224 forms a seal with the inner surface of the side member 204 and openings 222 formed in the elongate side members of the rigid frame 202. This seal ensures that aggregate material located within the frame 202 does not leak around the opening 222.

Figure 12:
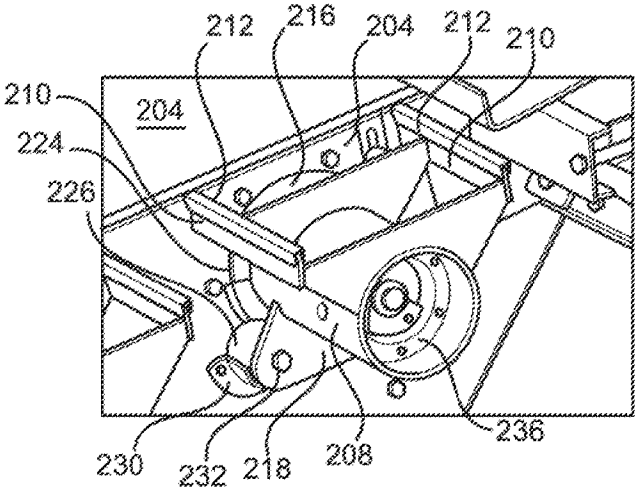
FIG. 12 is a sectional view of a horizontal member mounted to a frame of a vibratory screen assembly according to an embodiment of the present invention.
Figure 11:
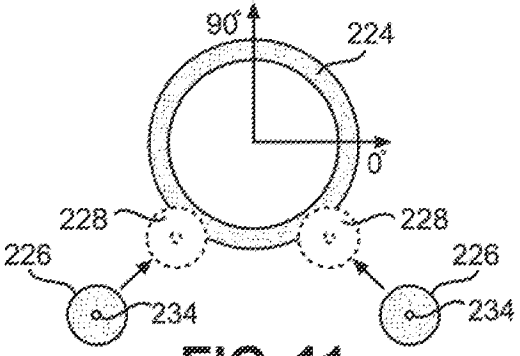
FIG. 11 depicts a vibration isolation seal configured for use with a tappet assembly according to an embodiment of the present invention.

Next, in certain embodiments, an outer periphery of the sealing ring 224 may include a pair of arc-shaped notches 228 located generally at the "5 o'clock" position (i.e., approximately 220° to approximately 260° or, more preferably, approximately 240° using the coordinate system shown in FIG. 11) and "7 o'clock" position (i.e., approximately 280° to approximately 320° or, more preferably, approximately 300° using the coordinate system shown in FIG. 11). These notches 228 are sized and configured to securely receive the vibration isolators 226. In the illustrated embodiment, the notches 228 are rounded and have a radius of curvature that is approximately equal to the external radius of the vibration isolators 226 such that outer surface of one of the vibration isolators securely seats into the notch. The other side of each of the vibration isolators 226 (i.e., the portion opposite the portion contacting the notch 228) is preferably supported within rounded cups 230 (a portion of one cup is shown in FIG. 12), which cups are mounted to an inside surface of side members 204.

Like the upper flange 216, the lower flange 218 serves as a gauge and provides positive feedback when the vibration isolators 226 are located at the correct location along the length of the horizontal member 208. Thus, vibration isolators 226 are preferably automatically located at the correct location along the length of the horizontal member 208 when they make contact with the lower flange 218. The lower flange 218 is preferably secured to side members 204 via a connection 232, such as a nut and bolt, which maintains a selected and adjustable spacing between the lower flange and the inner surface of the side member. In the illustrated case, the connection 232 is sized and configured to pass through an opening (not shown) in the lower flange, then through an opening 234 formed in the vibration isolator, and then through and opening (not shown) in the side member 204 such that the vibration isolators are seated within the notches 228 of the sealing ring 224. Preferably, the left-to-right distance (as shown in FIGS. 13 and 14) between the lower flange 218 and the inner surface of the side member 204 when the horizontal member 208 is attached to the frame 202 is less than the left-to-right width of the vibration isolators 226. As such, the vibration isolators 226 are each slightly compressed between the lower flanges 218 and the side member 204 when the horizontal member 208 is mounted to the frame 202. The vibration isolators 226 reduce the vibration into the frame 202 and, instead, forces the vibration through the screen 242 and the aggregate material being processed.

As shown best in FIG. 14, in certain cases, a distance D1 separates the inner surface of the elongate side member 204 (i.e., the right-hand surface in FIG. 14) and the corresponding upper flange 216. On the other hand, a distance D2, which is greater than distance D1, separates the inner surface of the elongate side member and the corresponding lower flange 218. As such, in this embodiment, notched sealing ring 224 is narrower (i.e., measured left-to-right in FIG. 14) than the cylindrical vibration isolators 226.

Figure 7:
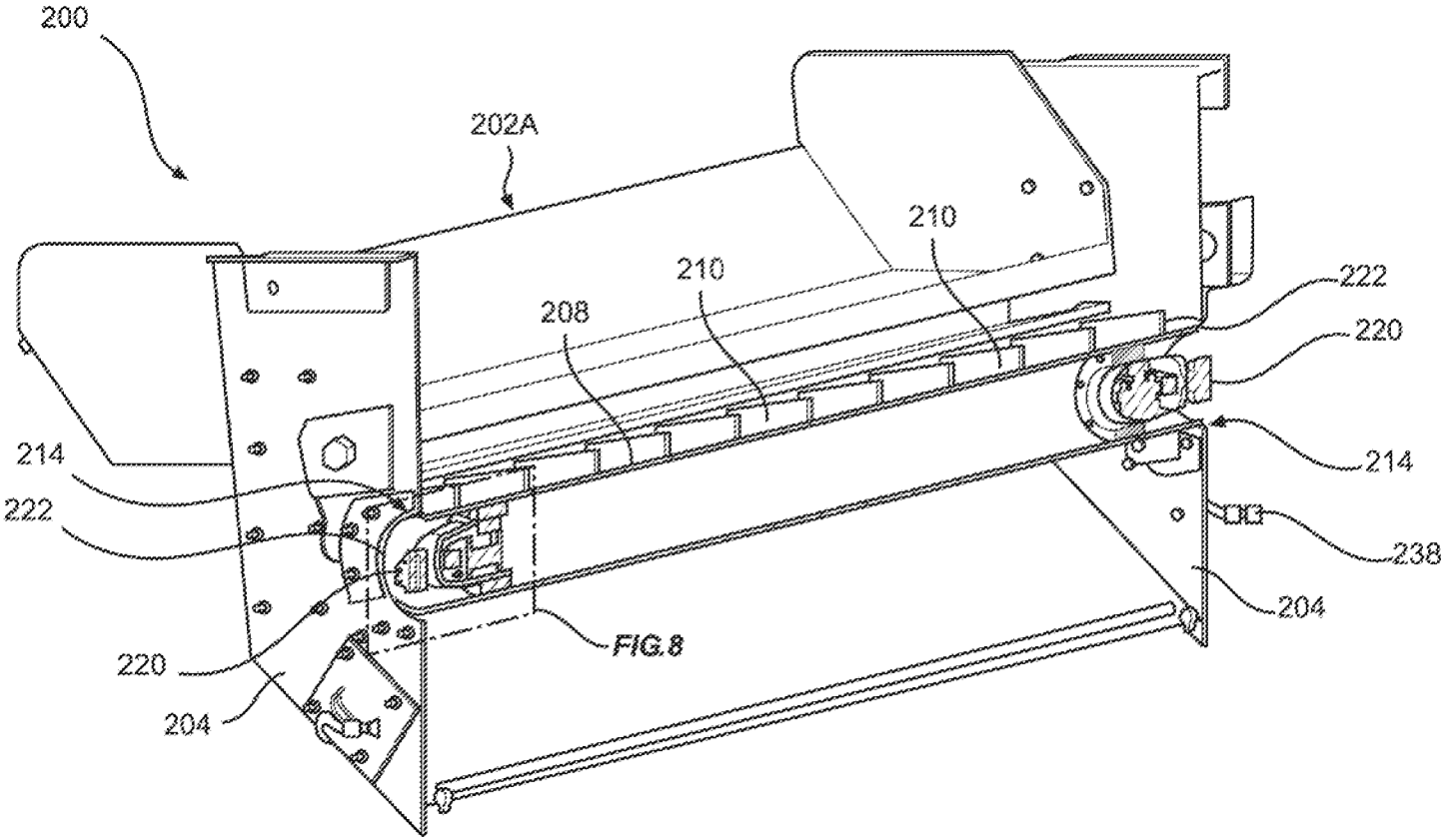
FIG. 7 is a sectional view of the vibratory screen assembly of FIG. 5A taken along a plane extending through the screen assembly perpendicular to flow direction F and depicting the tappet assembly of FIG. 6 mounted within the vibratory screen assembly of FIG. 5A.

Next, since each horizontal member 208 includes a pair of vibrator motors 220, the overall length of the horizontal member can be increased when compared to conventional vibratory screen assemblies while still providing sufficient vibratory motion to efficiently sort aggregate materials. This, therefore, would permit a much wider frame 202 to be used. As used above, the term "wider" (and similar terms such as "width") refers to a distance measured between the side members 204, as shown in FIG. 7. It may be appreciated that increasing the width of the frame 202 permits the volume the vibratory screen assembly 200 to be increased without changing the overall length of the vibratory screen assembly. This increase in volume, in turn, increases the speed at which the vibratory screen assembly 200 can process aggregate materials.

Lastly, by mounting vibrator motors 220 at the ends of the horizontal members 208, the largest vibrations (i.e., those with the highest amplitude) preferably occur towards the center of the horizontal member and not towards the ends of the horizontal member where the vibrator motors are located and where the smallest vibrations (i.e., those with the smallest amplitude) preferably occur. This would, therefore, promote movement of the aggregate material away from the large vibrations at the center of the horizontal members 208 and towards the relatively calmer ends where smaller vibrations occur. This, in turn, has the effect of spreading the aggregate material from the center of the screens 242 to their edges for a more even distribution of material across the screens and improved usage of the screen to more efficiently process material.

Figures 15A, 15B, 15C, 15D:
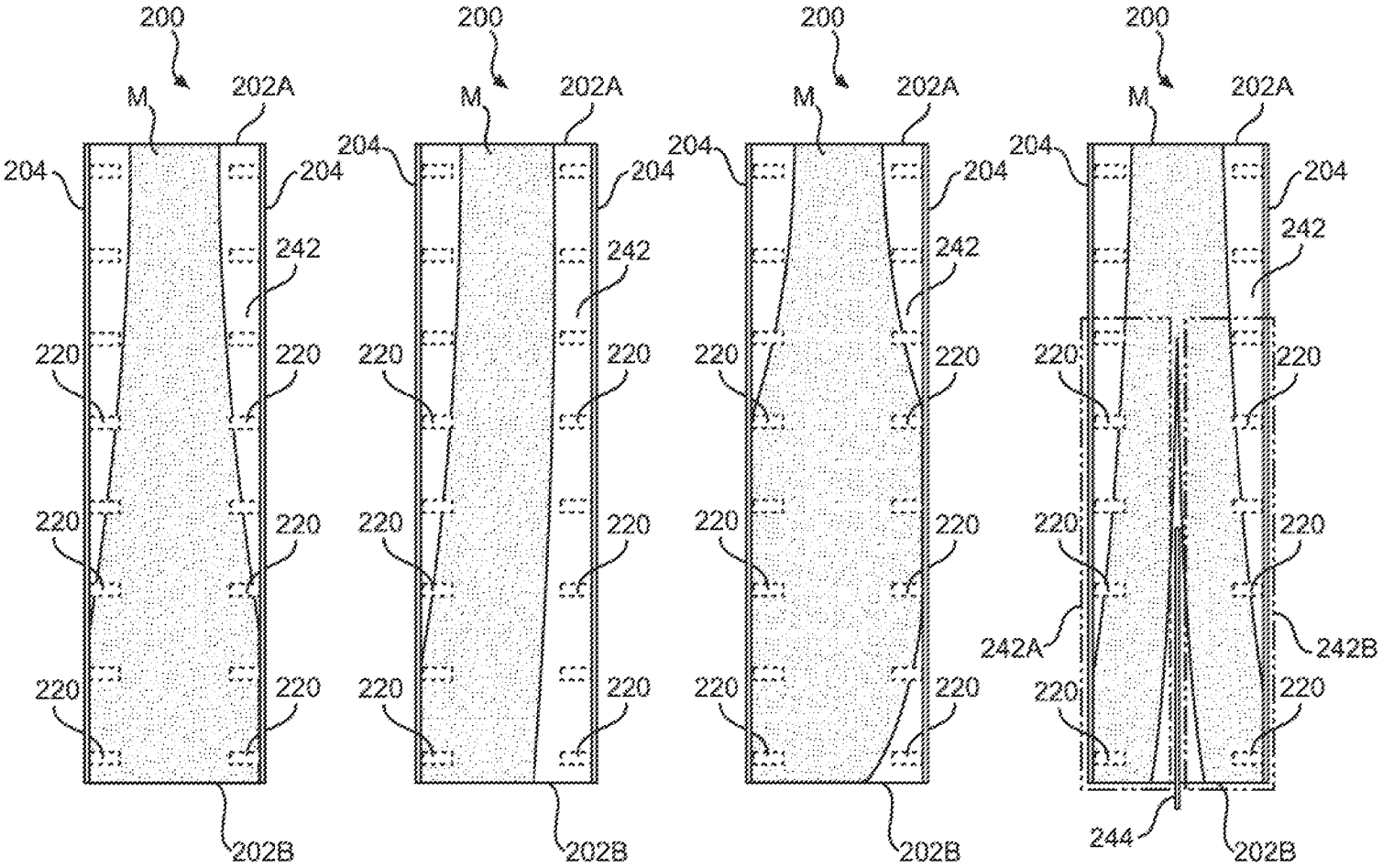
FIGS. 15A-15D illustrate patterns of aggregate material created on a vibratory screen of a vibratory screen assembly having tappet assemblies according to embodiments of the present invention.

With reference to FIGS. 15A-15D, there is provided several overhead views of a frame 202 and screen 242 of a vibratory screen assembly 200 according to embodiments of the present invention. In these views, several pairs of vibrator motors 220 are shown spaced along the length of the frame, where one vibrator motor of each pair is located at an end of a tappet assembly (not shown) and is disposed at an elongate side member 204. Each pair of vibrator motors 220 forms a cooperative pair of vibrator motors that vibrate in conjunction or in coordination with one another to induce a specific type of vibration within the horizontal member to which they are mounted and also in the screens 242 located above the horizontal members. In preferred embodiments, by modifying the speed and direction of vibrations caused by the vibrator motors 220 and the angle of incline of the screen 202 (with respect to the ground), the speed, direction, and shape of aggregate material M moving across the screen 242 can be selectively modified. For example, FIG. 15A depicts the basic pattern of spreading aggregate material across the width of the screen as it moves from the upper end 202A towards the lower end 202B of the frame 202. This would be accomplished, for example, by simply operating each of the vibrator motors 220 to provide vibrations having a similar speed and direction, which will cause the aggregate material M to naturally disperse across the screen 242.

In other cases, by operating vibrator motors 220 along one side or at a selection portion along the length of the frame 202 (i.e., between upper end 202A and lower end 202B) at a different speed or direction from those on an opposite side or at a different portion of the frame, unique patterns of aggregate material M may emerge. For example, in certain embodiments including the embodiment of FIG. 15B, the aggregate material may be pushed to one side of the screen by activating the vibrator motors located along one elongate side member 204 only and not activating (or activating at a lower amplitude/speed) the vibrator motors located along the opposite side member. This type of activation of the vibrator motors 220 will tend to push the aggregate material M towards or away from one of the elongate side members 204. As shown in FIG. 15C, this pushing function may be positioned at the upper end 202A of the screen or at the lower end 202B of the screen by modifying only a portion of the vibrator motors 220 on each side. In still other cases, as shown in FIG. 15D, the flow of aggregate material M may be split into two or more separate streams using the vibrator motors 220. This would allow, for example, the aggregate to be screened through separate screens 242A, 242B, which may have the same or different mesh size or mesh type. For example, screen 242A may be provided with a fine mesh, whereas screen 242B may be provided with an ultra-fine mesh. This would allow, for example, a single tappet assembly row to provide three or more separate streams of screened aggregate material, including a first portion that passes through screen 242A, a second portion that passes through screen 242B, and a third portion that is too large to pass through either screen. In certain embodiments, a divider 244 is provided to maintain separation between the first portion of material and the second portion of material after they pass through screens 242A, 242B.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations as would be appreciated by those having ordinary skill in the art to which the invention relates.

What is claimed is:

1. A vibratory screen assembly for classifying and separating aggregate materials into two or more size-segregated portions, the screen assembly comprising:

a rigid frame having a pair of elongate side members that are spaced apart and held in a generally parallel relationship to each other such that a space is provided between the elongate side members;

a tappet assembly extending horizontally across the space and between the elongate side members of the rigid frame, the tappet assembly including:

a horizontal member having opposing ends secured to the frame, wherein each opposing end comprises a hollow portion; and a separate vibrator motor disposed within the hollow portion located at each of the opposing ends of the horizontal member and forming a cooperative pair of vibrator motors that vibrate in conjunction with one another to induce vibrations in the horizontal member;

a screen placed over the tappet assembly, the screen providing a screening medium having a mesh size that is configured to separate aggregate materials placed onto the screen into two separate size-segregated portions, wherein, the screen vibrates as the horizontal member vibrates and, as the screen vibrates, aggregate material that is smaller than the mesh size passes through the screening medium and aggregate material that is larger than the mesh size does not pass through the screening medium.

2. The vibratory screen assembly of claim 1 further comprising:

a first tappet assembly row extending between an upper end proximate one longitudinal end of the rigid frame and a lower end proximate an opposite longitudinal end of the rigid frame, the first tappet assembly row formed by two or more tappet assemblies that each extend horizontally across the space and between the elongate side members of the rigid frame and that are vertically displaced from one another such that:

a first tappet assembly of the first tappet assembly row is at a highest vertical position with respect to the first tappet assembly row; and a second tappet assembly of the first tappet assembly row is located at a lowest vertical position with respect to the first tappet assembly row, wherein the screen is placed over the first tappet assembly row.

3. The vibratory screen assembly of claim 2 wherein the first tappet assembly row further includes one or more first intermediate tappet assemblies that each extend horizontally across the space between the first tappet assembly and the second tappet assembly of the first tappet assembly row, wherein the first intermediate tappet assemblies are vertically displaced from one another between the highest and lowest vertical position with respect to the first tappet assembly row.

4. The vibratory screen assembly of claim 2 further comprising:

a second tappet assembly row extending between the upper end and the lower end of the rigid frame that is vertically displaced with respect to the first tappet assembly row, the second tappet assembly row formed by two or more tappet assemblies that each extend horizontally across the space and between the elongate side members of the rigid frame and that are vertically displaced from one another such that:

a first tappet assembly of the second tappet assembly row is located at a highest vertical position with respect to the second tappet assembly row; and a second tappet assembly of the second tappet assembly row is at a lowest vertical position with respect to the second tappet assembly row, wherein a first screen having a first mesh size is placed over the first tappet assembly row and a second screen having a second mesh size is placed over the second tappet assembly row.

5. The vibratory screen assembly of claim 1 further comprising a plurality of a tappet assemblies each extending horizontally across the space and between the elongate side members of the rigid frame, wherein one or more screens are placed over the plurality of tappet assemblies to substantially fill the space within the frame.

6. The vibratory screen assembly of claim 1 further comprising open ends formed in each opposing end of the horizontal member of the tappet assembly and that communicate with one of the hollow portions and a pair of aligned openings formed in the frame, wherein when the tappet assembly extends between the elongate side members of the rigid frame, one of the open ends of the horizontal member is aligned with one of the aligned openings in the frame such that one of the vibrator motors may be inserted through one of the aligned openings in the frame and then into the open end in the end of the horizontal member and into the hollow portion.

7. The vibratory screen assembly of claim 6 wherein the horizontal member of the tappet assembly is a cylindrical tube.

8. The vibratory screen assembly of claim 6 further comprising connections that are connected to each of the vibrator motors and that are used in powering or controlling the vibrator motor, wherein a portion of the connections extend through the aligned openings in the frame in order to connect to the vibrator motor.

9. The vibratory screen assembly of claim 6 further comprising connections that are connected to each of the vibrator motors and that are used in powering or controlling the vibrator motor, wherein the connections are located exclusively outside of the frame when connected to the vibrator motor.

10. The vibratory screen assembly of claim 6 wherein the opening in the end of the horizontal member is sized such that a first end of the vibrator motor is located on an inner side of the side members of the rigid frame and a second end of the vibrator motor is located on an outer side of the side members of the rigid frame when the vibrator motor is connected to the horizontal member and the opposing ends of the horizontal member are secured to the side members of the rigid frame.

11. The vibratory screen assembly of claim 6 further comprising a bolting surface located proximate each opening in the ends of the horizontal member configured to mount to an end of one of the vibrator motors for securely connecting the vibrator motor to the horizontal member.

12. The vibratory screen assembly of claim 11 wherein the bolting surface is provided in a ring-shaped block fixedly attached inside of the horizontal member and having threaded bolt openings surrounding a center opening that are each configured to receive a bolt, the vibrator motor including corresponding openings to enable a bolt to pass through the openings in the vibrator motor and then threaded into the threaded bolt openings in the bolting surface.

13. The vibratory screen assembly of claim 1 further comprising:

a flange surrounding an outer surface of each end of the horizontal member; and a vibration isolating seal surrounding each end of the horizontal member, the vibration isolating seal in contact with and compressed between an inner surface of the elongate side member and the flange.

14. The vibratory screen assembly of claim 13 wherein:

the flange includes an upper flange that is located on and partially surrounds a top of the horizontal member and a separate lower flange that is located on and partially surrounds a bottom of the horizontal member, the vibration isolating seal includes:

a notched sealing ring having a pair of spaced apart arc-shaped notches that are formed in an outer periphery of the notched sealing ring, and a pair of cylindrical vibration isolators that are each sized to seat within one of the notches of the notched sealing ring, and wherein, when the horizontal member is mounted between the elongate side members, each of the notched sealing rings is compressed between one of said upper flanges and a corresponding one of said elongate side members, and each pair of cylindrical vibrations isolators is compressed between one of said lower flanges and a corresponding one of said elongate side members.

15. The vibratory screen assembly of claim 14 wherein a distance D1 separates the inner surface of the elongate side member and the corresponding upper flange and a distance D2, which is greater than distance D1, separates the inner surface of the elongate side member and the corresponding lower flange.

16. A tappet assembly configured for use in a vibratory screen assembly for classifying and separating aggregate materials into two or more size-segregated portions, where the screen assembly includes a rigid frame having a pair of elongate side members that are spaced apart and held in a generally parallel relationship to each other such that a space is provided between the elongate side members, the tappet assembly comprising:

a horizontal member having opposing ends and a hollow portion located at each opposing end, wherein the horizontal member is sized to extend across the space of the rigid frame when the opposing ends are secured to the side members; and a vibrator motor disposed within the hollow portion located at each of the opposing ends of the horizontal member, the vibrator motors forming a cooperative pair of vibrator motors that are configured to vibrate in conjunction with one another to vibrate the horizontal member.

17. The tappet assembly of claim 16 wherein the horizontal member of the tappet assembly is a cylindrical tube having opposing open and hollow ends and wherein the vibrator motors extend outwards from each of the open and hollow ends of the horizontal member such that a second end of the vibrator motors is spaced away from the open and hollow ends.

18. The tappet assembly of claim 17 further comprising: a screen support that extends away from a top of the cylindrical tube and that is configured to support a screen above the cylindrical tube; a screen interface removably attached to screen support and configured to be contacted by said screen and to hold said screen in position above the cylindrical tube when the cylindrical tube is vibrated.

19. A method for separating aggregate material into two or more size-segregated portions comprising the steps of:

providing vibratory screen assembly having:

a rigid frame having a pair of elongate side members that are spaced apart and held in a generally parallel relationship to each other such that a space is provided between the elongate side members;

a tappet assembly row extending along at least a portion of a length of the rigid frame and comprised of a plurality of vertically separated tappet assemblies, each tappet assembly including: a horizontal member having opposing ends secured to the frame, a hollow portion formed in each of the opposing ends of the horizontal member, and a cooperative pair of vibrator motors mounted to each horizontal member that vibrate in conjunction with one another, wherein one vibrator motor of the pair of vibrator motors is disposed within the hollow portion at each of the opposing ends of the horizontal member, each cooperative pair of vibrator motors including one vibrator motor disposed at each opposing end of the horizontal member;

a screen providing a screening medium having a mesh size placed over the tappet assembly row;

placing unscreened aggregate material onto the screen;

creating vibrations in the screen using one or more of the vibrator motor pairs to move the aggregate material across the screen; and as a result of the vibrations in the screen and the movement of the aggregate material across the screen, separating the aggregate material into two or more size-segregated portions, including a larger portion located on top of the screen and a smaller portion located underneath the screen.

20. The method of claim 19 further comprising the steps of:

operating the vibrator motors in a first operational mode to provide a first shape of aggregate material moving across the screen; and operating the vibrator motors in a second operational mode to provide a second shape of aggregate material moving across the screen.

* * * * *